US011623245B2

(12) United States Patent
Wuchinich et al.

(10) Patent No.: US 11,623,245 B2
(45) Date of Patent: Apr. 11, 2023

(54) COMPACT ULTRASONIC ATOMIZERS USING FOLDED RESONATORS

(71) Applicants: David Wuchinich, Bronx, NY (US); Liat Keng Kang, Singapore (SG); William Tan, San Gabriel, CA (US)

(72) Inventors: David Wuchinich, Bronx, NY (US); Liat Keng Kang, Singapore (SG); William Tan, San Gabriel, CA (US)

( * ) Notice: Subject to any disclaimer, the term of this patent is extended or adjusted under 35 U.S.C. 154(b) by 741 days.

(21) Appl. No.: 16/683,533

(22) Filed: Nov. 14, 2019

(65) Prior Publication Data

US 2020/0156113 A1 May 21, 2020

Related U.S. Application Data

(60) Provisional application No. 62/907,443, filed on Sep. 27, 2019, provisional application No. 62/895,862, filed on Sep. 4, 2019, provisional application No. 62/767,547, filed on Nov. 15, 2018.

(51) Int. Cl.

| | |
|---|---|
| ***B06B 1/06*** | (2006.01) |
| ***B06B 1/02*** | (2006.01) |
| ***B01F 23/213*** | (2022.01) |

(52) U.S. Cl.

CPC ..... *B06B 1/0655* (2013.01); *B01F 23/2133* (2022.01); *B06B 1/0238* (2013.01); *B06B 2201/77* (2013.01)

(58) Field of Classification Search

CPC ..... B06B 1/0655; B06B 1/0238
USPC ..... 310/369
See application file for complete search history.

(56) References Cited

U.S. PATENT DOCUMENTS

| | | | | |
|---|---|---|---|---|
| 3,283,182 | A | 11/1966 | Jones | |
| 4,425,115 | A | 1/1984 | Wuchinich | |
| 4,526,571 | A | 7/1985 | Wuchinich | |
| 4,750,488 | A | 6/1988 | Wuchinich | |
| 4,796,807 | A | 1/1989 | Bendig | |
| 4,930,512 | A | 6/1990 | Henricksen | |
| 5,152,456 | A | 10/1992 | Ross | |
| 5,167,619 | A | 12/1992 | Wuchinich | |
| 5,199,004 | A * | 3/1993 | Monahan | B06B 1/0655 310/369 |

(Continued)

OTHER PUBLICATIONS

U.S. Appl. No. 62/767,547, filed Nov. 15, 2018.

(Continued)

*Primary Examiner* — Derek J Rosenau
(74) *Attorney, Agent, or Firm* — Law Office of David Hong

(57) ABSTRACT

A vibrating piezoelectric atomizer comprising: a piezoelectric tube having a length, a first end defining an opening and a second end, the second end of the piezoelectric transducer tubular body is connected to a horn; the horn is dimensioned to be half wavelength resonator; the horn is folded and located alongside the piezoelectric tube; a metallic disk is connected to the horn near the first end of the piezoelectric tube, whereby by applying an alternating voltage across electrodes of the piezoelectric tube, the piezoelectric tube is excited into a resonant vibration when frequency of excitation equals to half wavelength resonant frequency of the piezoelectric tube's length and vibrates in synchronism and is communicated to the metallic disk to atomize a liquid.

16 Claims, 6 Drawing Sheets

(56) References Cited

U.S. PATENT DOCUMENTS

| | | | | |
|---|---|---|---|---|
| 5,221,282 | A | 6/1993 | Wuchinich | |
| 5,811,909 | A | 9/1998 | Wuchinich | |
| 6,086,369 | A | 7/2000 | Sharp | |
| 6,161,782 | A | 12/2000 | Heinbuck | |
| 6,278,218 | B1 | 8/2001 | Madan | |
| 6,539,937 | B1 | 4/2003 | Huveri | |
| 7,762,979 | B2 | 7/2010 | Wuchinich | |
| 8,610,334 | B2 | 12/2013 | Bromfield | |
| 9,962,183 | B2 | 5/2018 | Wuchinich | |
| 10,272,404 | B2 | 4/2019 | Liu | |
| 10,335,754 | B2 | 7/2019 | Liu | |
| 2004/0047485 | A1 | 3/2004 | Sherrit | |
| 2006/0244347 | A1* | 11/2006 | Bae | B41J 2/14274 310/369 |
| 2006/0283896 | A1 | 12/2006 | Kasting | |
| 2008/0128527 | A1 | 6/2008 | Chan | |
| 2010/0044460 | A1 | 2/2010 | Sauzade | |
| 2015/0151058 | A1 | 6/2015 | Abate | |
| 2017/0120284 | A1 | 5/2017 | Paunescu | |
| 2017/0197041 | A1 | 7/2017 | Knudsen | |

OTHER PUBLICATIONS

U.S. Appl. No. 62/895,862, filed Sep. 4, 2019.
U.S. Appl. No. 62/907,443, filed Sep. 27, 2019.
U.S. Appl. No. 62/314,380, filed Mar. 28, 2016.
U.S. Appl. No. 62/343,086, filed May 30, 2016.
U.S. Appl. No. 15/004,920, filed Jan. 23, 2016.
PCT/US2016/014646, filed on Jan. 23, 2016.
U.S. Appl. No. 62/106,852, filed Jan. 23, 2015.
U.S. Appl. No. 62/142,464, filed Apr. 2, 2015.

* cited by examiner

COMPACT ULTRASONIC ATOMIZERS USING FOLDED RESONATORS

This application claims the benefit of U.S. Provisional Patent Appl. No. 62/767,547, filed on Nov. 15, 2018; U.S. Provisional Patent Appl. No. 62/895,862, filed on Sep. 4, 2019; and U.S. Provisional Patent Appl. No. 62/907,443, filed on Sep. 27, 2019, which are all incorporated by reference in entirety.

This application is also related to U.S. Provisional Appl. 62/314,380, filed on Mar. 28, 2016 and 62/343,086, filed May 30, 2016; U.S. patent application Ser. No. 15/004,920, filed on Jan. 23, 2016 and PCT/US2016/014646, filed on Jan. 23, 2016; U.S. Provisional No. 62/106,852, filed on Jan. 23, 2015 and 62/142,464, filed on Apr. 2, 2015; all listed applications are incorporated by reference in entirety.

1. FIELD OF THE INVENTION

Improvement for integrating a transducer with a folded resonator.

2. DESCRIPTION OF RELATED ART

The use of ultrasonic vibration to atomize fluids is a well-established technology (see Frederick, J., Ultrasonic Engineering, Wiley 1965, pp 152-55. Methods of Experimental Physics, Vol. 19, pp. 333-6, Academic Press, 1981). Liquids introduced onto a surface vibrating at an ultrasonic frequency can be subjected to very large accelerating forces that surpass their cohesive tensile strength and surface tension, resulting in the formation of droplets that separate from the parent body of fluid and leave the surface, possessing acceleration imparted by the surface's motion. As an example, consider a 100 micron thick film of water placed on a surface vibrating sinusoidally at 40 kHz with an amplitude of 10 microns. The film is subject to an acceleration of about 630,000 meters per second per second or 64,000 times that of gravity. The tensile stress in the film is its density multiplied by the product of the film thickness and the acceleration, which for 40 kHz vibration of an amplitude of 10 microns is 63 kPa which is above the tensile strength of tap water. The water separates into droplets that are propelled away from the surface, forming a stream of vapor. This phenomenon forms the basis of operation of ultrasonic humidifiers and nebulizers as well as fuel injectors.

It is known that ultrasonic atomization is a sensitive function not only of the fluid's tensile strength but also of its surface tension and, particularly, viscosity. Of interest here is the development of compact ultrasonic atomizers that are able to vaporize fluids, including those having viscosities and surface tensions substantially greater than that of water and that have a simple construction and compact geometry. For example, certain medicines can be efficaciously and conveniently administered in vapor form but are resistant to vaporization by ultrasonic nebulizers that are effective with water. It has been shown that such fluids must be subject to significantly greater amplitudes of ultrasonic motion at any given frequency than are necessary using water to experience atomization.

Ultrasonic humidifiers typically use piezo-electric disks vibrating in resonance to generate motion. Ultrasonic nebulizers may use disks or bimorphs attached to a metal diaphragm to perform the same function. However, neither arrangement generates motion sufficient to atomize fluids having viscosities ten times or more larger than that of water.

U.S. Pat. No. 9,533,323B2 discloses the use of a conventional Langevin transducer to produce ultrasonic motions larger than are available from aqueous humidifiers and nebulizers. The structures shown in that patent, however, contain many separate parts in an elaborate assembly not having the same economy in manufacture, use and servicing as that afforded by a simple construction.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the drawings.

SUMMARY OF THE INVENTION

This invention presents at least one preferred embodiment for a vibrating piezoelectric atomizer for atomizing a liquid comprising: a piezoelectric transducer tubular body, having a length, a first end defining an opening, a second end and connected electrodes to a power source; the second end of the piezoelectric transducer tubular body is connected to a horn; the horn is dimensioned to be a half wavelength resonator; the horn is folded and located alongside the piezoelectric transducer tubular body; a metallic disk is connected to the horn near the first end of the piezoelectric transducer tubular body; whereby by applying an alternating voltage from a battery across the connected electrodes of the piezoelectric transducer tubular body, the piezoelectric transducer tubular body is excited into a resonant vibration when frequency of excitation equals to half wavelength resonant frequency of the piezoelectric transducer tubular body's length and vibrates in synchronism and is communicated to the metallic disk to atomize the liquid. The metallic disk is perforated or has at least one hole and a plastic cover with perforations. The horn can lie within or outside the piezoelectric transducer tubular body. A wick can transfer the liquid to the metallic disk. The piezoelectric transducer tubular body can have an inside surface and an outside wall; the electrical contacts can be coupled to the inner surface and outside wall; the power source can be a battery.

A vibrating piezoelectric atomizer for atomizing a liquid comprising: a piezoelectric tube having a length, a first end and a second end and electrodes, which are connected to a power source; a resonator; a first endcap and a second endcap engage the first end and the second end of the piezoelectric tube and the resonator; a metallic disk (perforated or has at least one hole or a plastic cover with perforations) is connected to one of the endcaps near the first end of the piezoelectric tube; whereby by applying an alternating voltage across electrodes of the piezoelectric tube, the piezoelectric tube is excited into a resonant vibration when frequency of excitation equals to half wavelength resonant frequency of the piezoelectric tube's length and vibrates in synchronism and is communicated to the metallic disk to atomize the liquid.

The second resonator can be a mass-spring-mass mechanical oscillator with the casing being the spring and the caps being the masses; a wick transfers the liquid to the metallic disk' the piezo body has an inside surface and an outside wall; the electrical contacts are coupled to the inner surface and outside wall. There can be use of right-hand and left-hand threads, which ensure that the tightening process does not introduce torsion to the piezo tube. The resonator can lie approximately at a center portion of the length of the piezoelectric tube and where there is very little vibratory motion.

BRIEF DESCRIPTION OF THE DRAWINGS

In FIGS. 1A and 1B, the casing or transducer horn is enclosed by the piezo tube.

A fluid is placed on the upper surface of the disk or communicated to the lower surface of a perforated disk, via a wick; the fluid will be atomized into an aerosol once the assembly is excited into resonance.

Figure 2A:
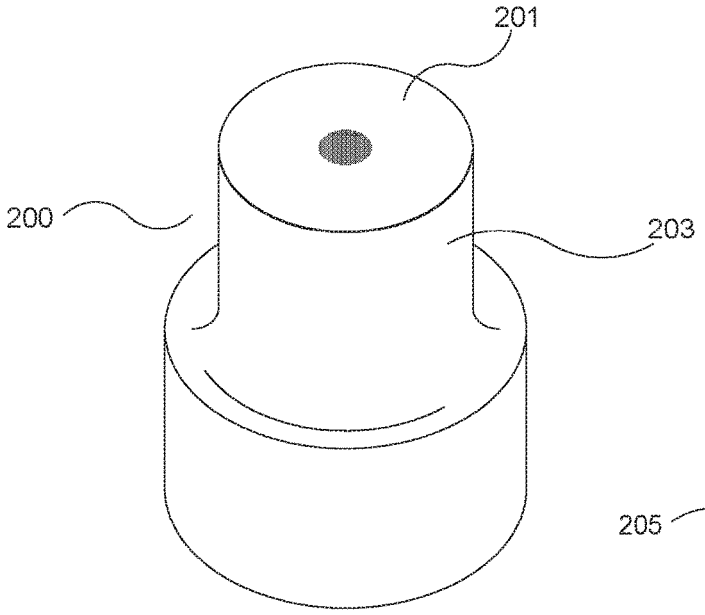
Figure 2B:
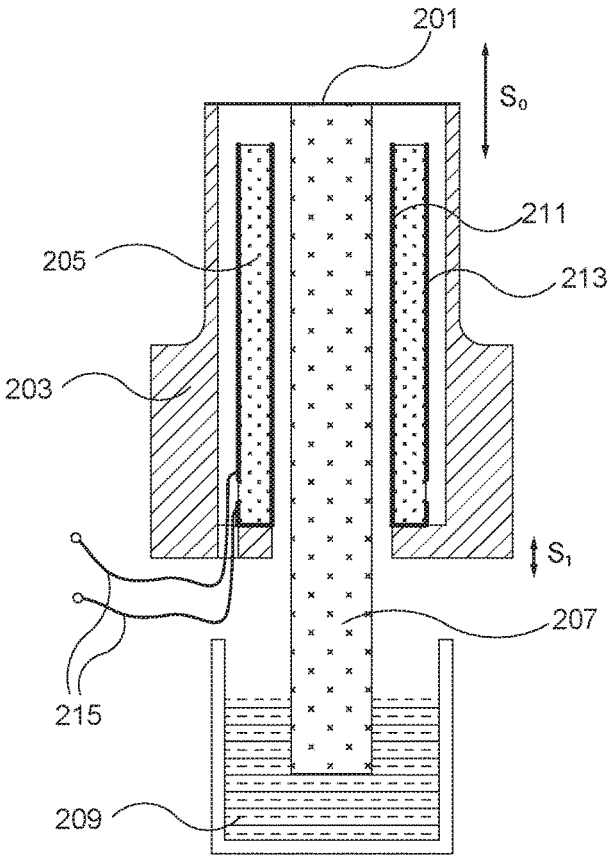

FIGS. 2A and 2B are, respectively, isometric and cross-sectional views of another construction for a folded transducer. In this variation the casing, rather than being enclosed by the piezo tube, surrounds the tube. Access to the tube's electrodes is provided again by wires that are routed through a small hole in the casing.

Similarly, fluid is placed on the upper surface of the disk or communicated to the lower surface of a perforated disk, via a wick; the fluid will be atomized into an aerosol once the assembly is excited into resonance.

In the embodiment in group FIGS. 3 and 4, the disk is sandwiched between the Upper Cap and the Piezo tube; where the caps are held stationary and casing turned, the disk can be clamped during "pre-stressing," which provides additional acoustical coupling between the two resonators and the disk itself, but the disk again can be bonded to the Upper Cap and to the Piezo tube.

Figure 3A:
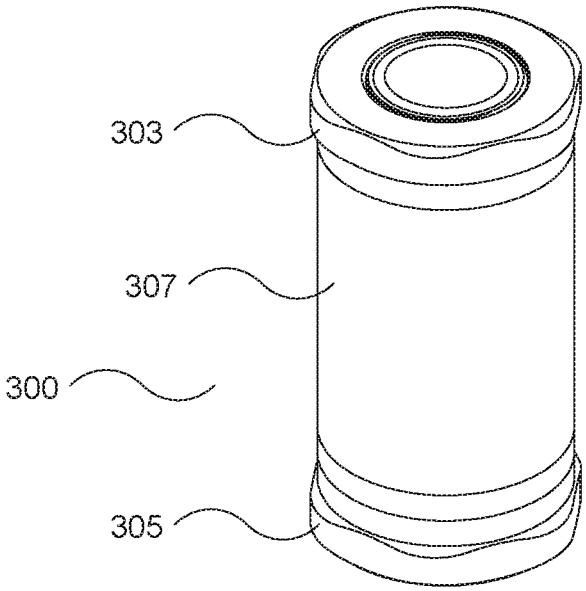
Figure 3B:
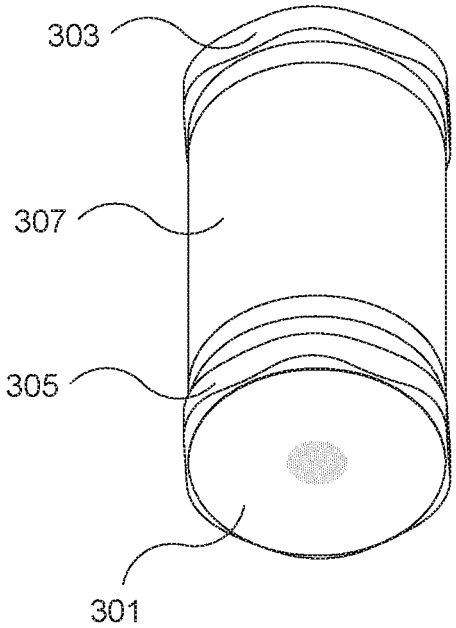
Figure 3C:
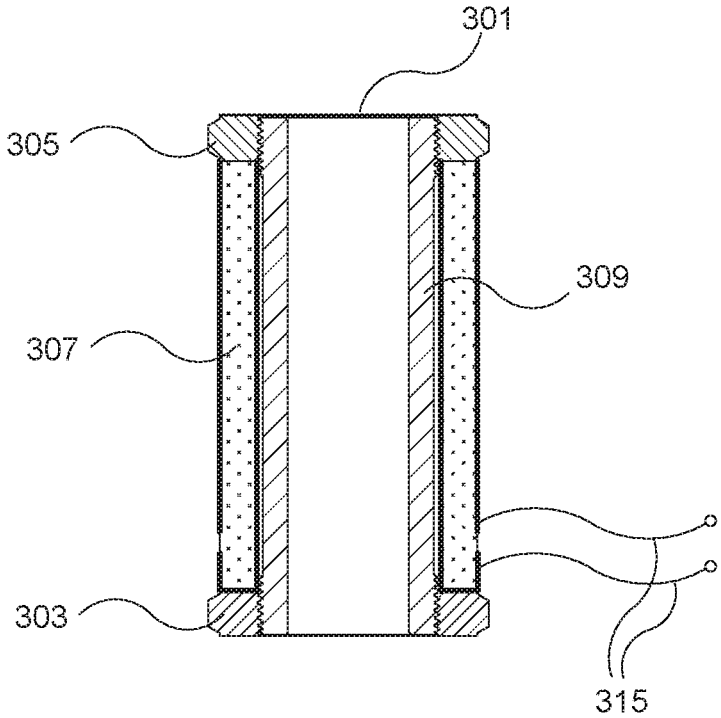

In FIGS. 3A, 3B and 3C, the resonators are first the Piezo Tube and, second, the casing and the Upper and Lower Caps. The Lower Cap can also be bonded to the Piezo tube with all bonding accomplished before pre-stressing.

Figure 4A:
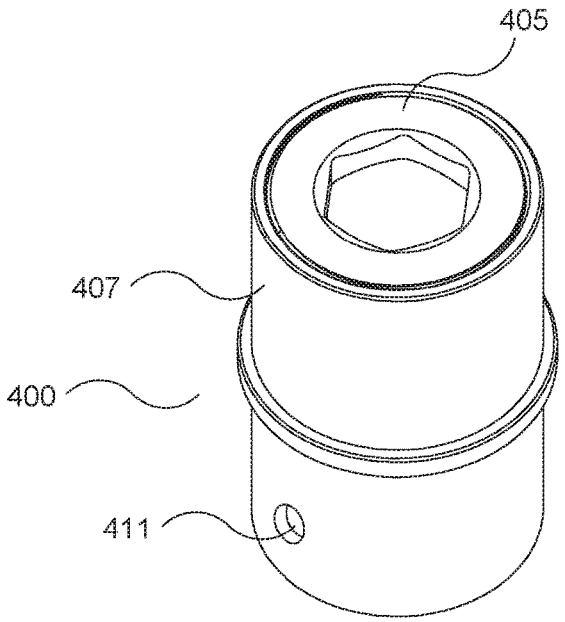
Figure 4B:
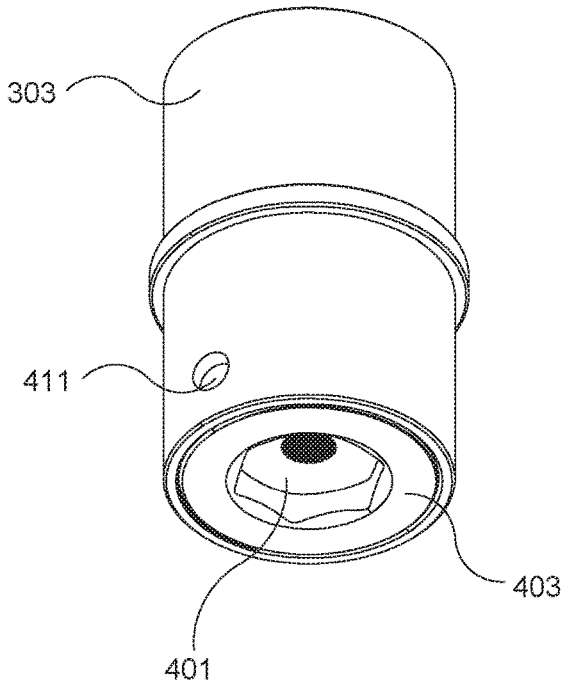
Figure 4C:
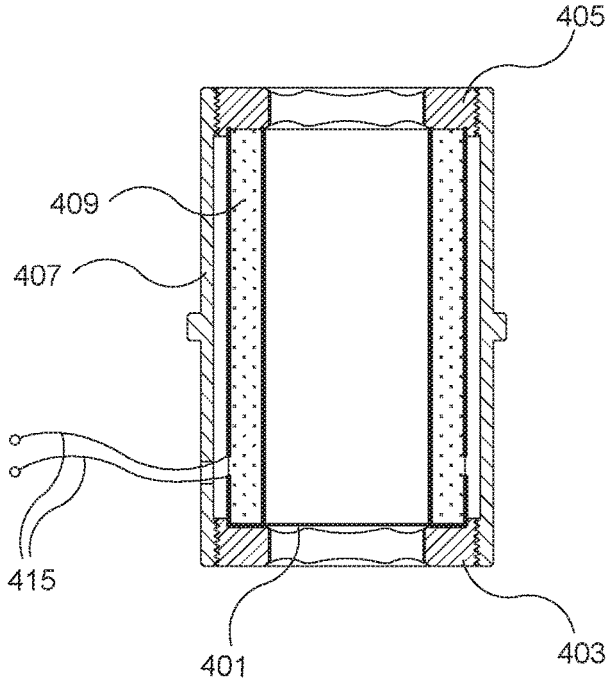

In FIGS. 4*a*, 4*b* and 4*c* the casing contains a flange to permit mounting the folded transducer into an enclosure. Vibratory motion is minimized at this location, permitting the use of elastomeric fixation using O rings or other compliant means.

FIG. 3A and FIG. 3B show perspective views of one embodiment of a folded transducer; FIG. 3C is a cross-sectional view thereof; the resonator is within the piezo tube. Parts 309, 305 and 303 form turnbuckle mechanisms or devices, which perform pre-stressing of the assembly that was disclosed by Jones and Maropis. Part No. 303 and 305 are the top and bottom caps; Part No. 309 is the "stem."

FIGS. 4A and 4B are, respectively, isometric and axonometric views of another construction for a folded transducer. FIG. 4C is a cross sectional view of the construction. FIG. 4A and FIG. 4B, the resonator is outside the piezo tube. Parts 407, 405 and 403 are turnbuckle mechanisms or devices, which perform pre-stressing of the assembly that was disclosed by Jones and Maropis.

Figure 5:
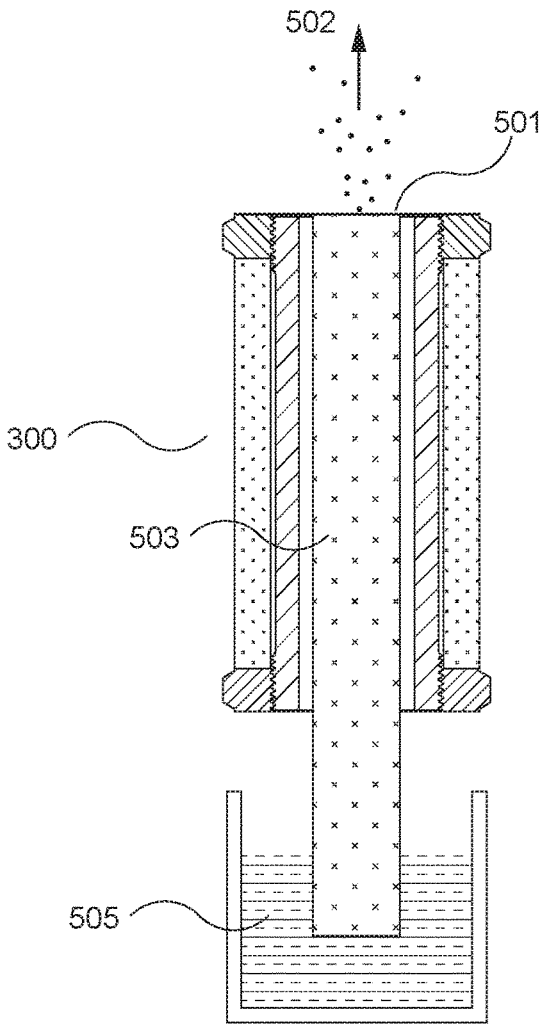

FIG. 5 illustrates the use of a wick to convey fluid from a reservoir to the underside of a perforated disk where atomization and the production of an aerosol occurs.

Figure 6:
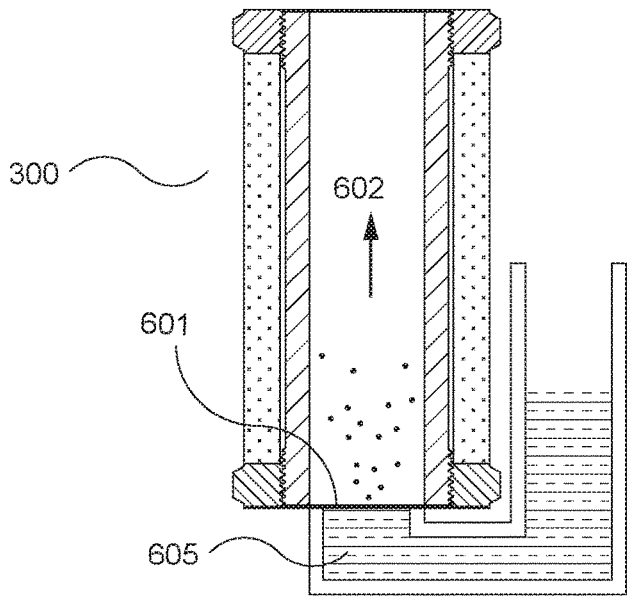

FIG. 6 illustrates an alternative method of administering the fluid to the underside of a perforated disk. In this arrangement the fluid is atomized with the aerosol emits through the tubular opening of the casing.

Figure 7:
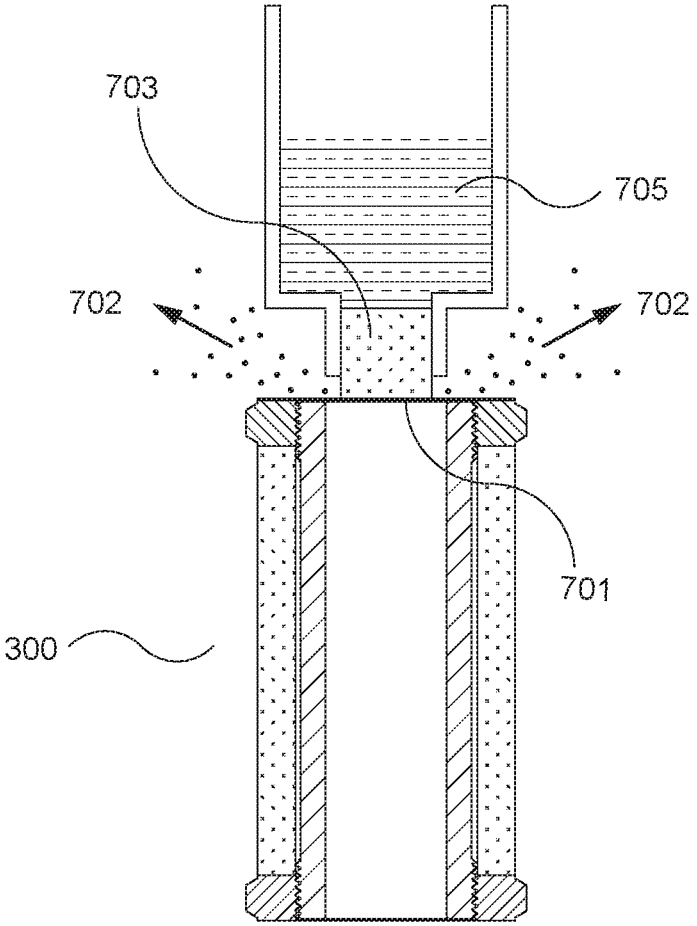

FIG. 7 represents yet another method of producing an aerosol using an unperforated disk. The fluid is administered through a wick onto the upper surface of the disk where it is atomized by ultrasonic vibration and emitted as an aerosol.

PARTS LISTING

100 Ultrasonic atomizer
101 perforated metal disk
103 horn
105 piezo-electric tube
107 wick
109 liquid to be vaporized
111 ID electrode
113 OD electrode
115 electrical connections
200 Ultrasonic atomizer
201 perforated metal disk
203 horn
205 piezo-electric tube
207 wick
209 liquid to be vaporized
211 ID electrode
213 OD electrode
215 electrical connections
300 Ultrasonic atomizer (dumb-bell resonator)
301 metal or titanium disk, which may have perforations.
309 horn or resonator casing
307 piezo-electric tube
303, 305 caps (can be threaded)
315 electrical connections
400 Ultrasonic atomizer (dumb-bell resonator)
401 metal or titanium disk, which may have perforations.
407 horn or resonator casing
409 piezo-electric tube
403, 405 caps (can be threaded)
411 opening in the horn or resonator casing (for tube's electrodes)
415 electrical connections
501 metal or titanium disk, which may have perforations.
502 atomized particles or vapor
503 wick
505 liquid to vaporized
601 metal or titanium disk, which may have perforations.
602 atomized particles or vapor
605 liquid to vaporized
701 metal or titanium disk, without perforations.
702 atomized particles or vapor
703 wick
705 liquid to vaporized

DETAILED DESCRIPTION

Figure 1A:
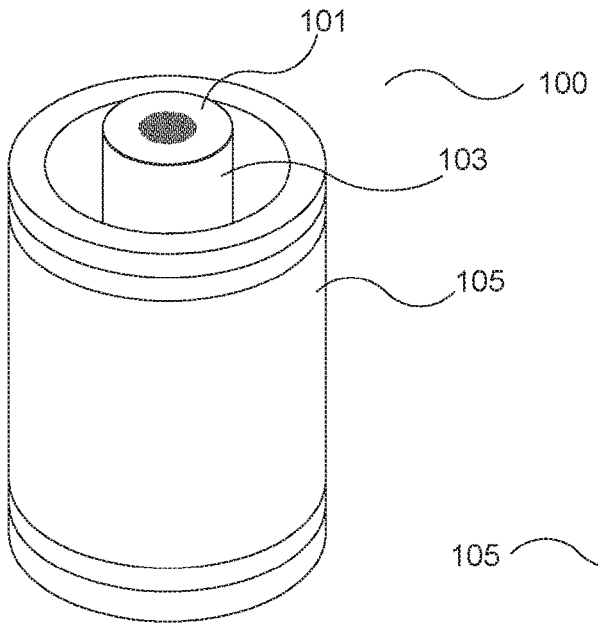
FIGS. 1A and 1B are, respectively, isometric and cross-sectional views of one form of a folded transducer.
Figure 1B:
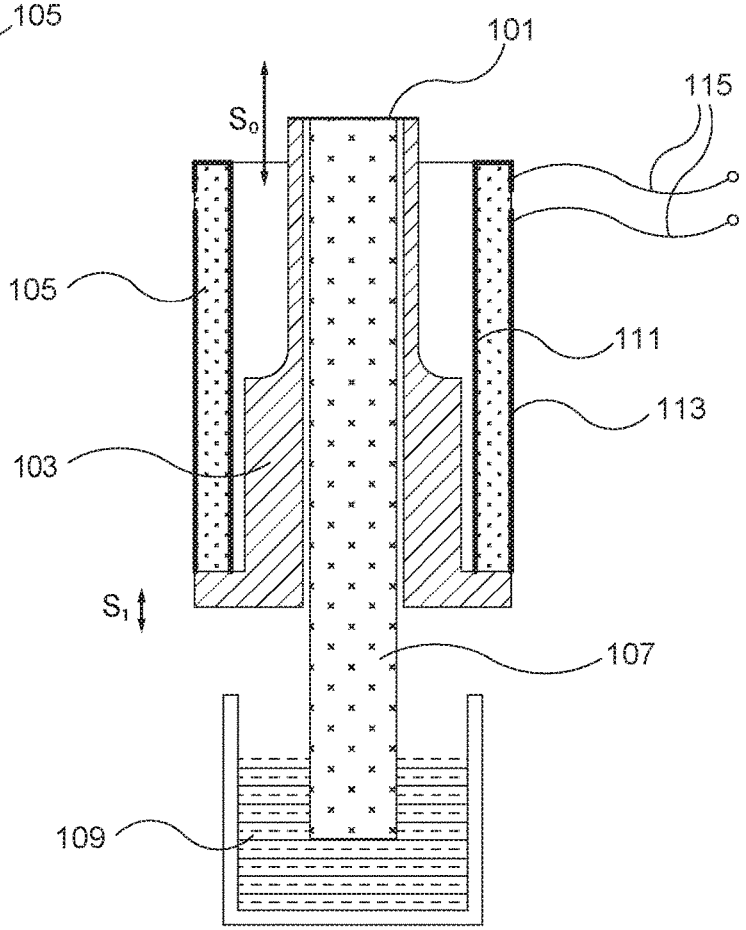

As in FIGS. 1A and 1B, a transducer 100 is composed to two principal parts, a piezo-electric tube 105 and a horn 103. Both the tube and the horn are dimensioned to be half wavelength resonators and are attached to each other at one end using adhesives or any conventional fastening method. The construction of the transducer is termed folded because the horn is set inside the piezo-electric tube rather than just extending from it. As a result, the length of the transducer is half that of the conventional design, thereby offering a compact construction.

The piezo-electric tube is excited into resonant vibration along its length by impressing an alternating voltage across its electrodes (111, 113; 211, 213) having a frequency equal to its length expansion and contraction resonance. While the excitation through the wall thickness of the tube does produce diametrical expansion and contraction, Poisson coupling produces expansion and contraction of the tube's length which, when the frequency of excitation equals the half wavelength resonant frequency of the tube's length, lengthwise dynamic displacement of the tube's faces occurs.

The horn is designed to have an extensional resonant frequency approximately that of the tube so that both vibrate in synchronism. While the vibration of the tube, ($S_1$), is equal and opposite in direction at its opposite ends, the horn, receiving the tube's vibration at its end attached to the tube, produces a much greater amplitude ($S_0$), at its other end (which is connected to the thin perforated metal disk).

The end of the horn that is not fastened to the tube is attached to a thin perforated metal disk 101. The motion of the horn at this junction is communicated to the disk. Although a stepped horn is shown in the drawings (FIGS. 1A and 1B), many different configurations producing an amplification of motion are possible, including tapered, Poisson, catenoidal, exponential and Gaussian geometries, among others. The horn itself may be made of metal or thermosetting composite materials or any material able to withstand the dynamic stress incurred in producing the requisite motion of the metal disk.

Following conventional and established art, a cylindrically shaped wick 107, one end of which is placed in the fluid 109, is in contact with the underside of the disk, as it is placed in the hollow passage through the horn. The wick 107, 207 brings fluid 109, 209, contained in a well, to the underside of horn through capillary action, and the vibration atomizes the fluid, which leaves the disk through the perforations.

FIGS. 2A and 2B illustrate an alternative configuration 200; the horn 203 is placed outside the piezo-electric tube 205, but the operation is identical to that described for FIGS. 1A and 1B. The embodiment of FIG. 2A permits a larger diameter perforated disk 201 to be used for the same overall diametrical dimension. Electrical connections 115, 215 to the tube are made through a hole in the horn's flange, upon which the piezo-electric tube is mounted.

Additional embodiments of the invention are shown in the second group of FIGS. 3 and 4, which utilize a folded resonator 300 patterned after a spool, sometimes referred to as dumb-bell resonators; these dumb-bell resonators were first disclosed by Mason (Methods of Experimental Physics, Vol. 19, pp. 345-7, Academic Press, 1981) and the use of a turnbuckle mechanism to perform pre-stressing of the assembly that was disclosed by Jones and Maropis (U.S. Pat. No. 3,283,182, 1966).

FIGS. 3A and 3B are, respectively, isometric and axonometric views of one form of a folded transducer 300. FIG. 3C is a cross sectional view of the same transducer 300. The folded resonator consists of two extensional resonators, the first the piezo tube 307 and the second a resonator formed by the casing 309 and the Upper and Lower Caps 303, 305. The second resonator comprises a mass-spring-mass mechanical oscillator with the casing being the spring and the caps being the masses. Such oscillators are well known in the art and can be constructed such that their extensional resonance occurs at a length approximately equal to that of the piezo tube even though the elastic modulus of the casing may be much greater than that of the tube. Typically, the tube is made from PZT 8 material, the casing of stainless steel and the caps of 6A1-4V titanium.

With the caps held stationary, the casing is turned by applying a wrench to keyed slots in the casing (not shown) to compress the caps against the tube, forming an acoustic joint between the tube and the caps and hence the casing itself. Use of right-hand and left-hand threads ensures that the tightening process does not introduce torsion to the piezo tube. Such torsion, if present, can precipitate fracture of the tube during the tightening process.

Bonded to the upper cap is a titanium disk 301 whose center portion may contain perforations. The bonding mechanism may be high strength epoxy or the disk may be welded to the upper cap using electron beam or laser welding equipment. When the assembly is excited into resonance by applying an alternating voltage of the appropriate frequency to the electrodes of the tube through the wires 315 shown, the disk is also excited into flexural resonance whose up and down motion is particularly acute at its center portion. Fluid applied to the upper surface of the disk or via a fluid carrying wick inserted into the tubular cavity of the casing and reaching the underside of a perforated disk will be atomized into an aerosol appropriate for inhalation.

Aside from the bonding of the disk to the Upper Cap, the joints between the Upper and Lower Caps and the surfaces of the piezo tube may also be bonded using high strength epoxy adhesive. This bonding process is accomplished before pre-stressing is applied to the assembly. Such bonds serve to improve the integrity of the acoustic joints which couple the two resonators and ensure the communication of vibration between Piezo tube and the casing and end caps.

A region located approximately at the center length of the Piezo Tube provides a surface useful for mounting the transducer in an enclosure. In this region, there is very little vibratory motion, permitting the use of elastomeric material to fixate the assembly within an outer rigid housing and thereby electrically insulating the voltages present on the surface of the tube and preventing contact of the driving voltage from being communicated to the housing.

FIGS. 4A and 4B are, respectively, isometric and axonometric views of another construction for a folded transducer 400. FIG. 4C is a cross sectional view of the construction.

In this variation, rather than being enclosed by the piezo tube 409, the casing or transducer horn 407 surrounds the piezo tube 409. Access to the tube's electrodes is provided again by wires 415 that are routed through a small hole 411 in the casing. In this construction, the disk 401 is sandwiched between the Cap and the Piezo tube and, as such, when the caps 403, 405 are held stationary and casing turned, the disk 401 is clamped during pre-stressing which provides additional acoustical coupling between the two resonators and the disk itself, but the disk again can be bonded to the Upper Cap and to the Piezo tube. As in FIGS. 3A, 3B and 3C, the resonators are first the Piezo Tube and, second, the casing and the Upper and Lower Caps. The Lower Cap can also be bonded to the Piezo tube with all bonding accomplished before pre-stressing.

As in FIGS. 3A, 3B and 3C, fluid placed on the upper surface of the disk or communicated to the lower surface of a perforated disk, via a wick, will be atomized into an aerosol once the assembly is excited into resonance.

The casing contains a flange to permit mounting the folded transducer into an enclosure. Vibratory motion is minimized at this location, permitting the use of elastomeric fixation using 0 rings or other compliant means.

FIG. 5 illustrates the use of a wick 503 to convey fluid 505 from a reservoir to the underside of a perforated disk 501 where atomization and the production of an aerosol 502 occurs.

FIG. 6 illustrates an alternative method of administering the fluid 605 to the underside of a perforated disk 601. In this arrangement the fluid is atomized with the aerosol 602 emits through the tubular opening of the casing.

FIG. 7 represents yet another method of producing an aerosol 702 using an unperforated disk 701. The fluid 705 is administered through a wick 703 onto the upper surface of the disk where it is atomized by ultrasonic vibration and emitted as an aerosol.

Detailed embodiments of the present invention are disclosed; however, the disclosed embodiments are merely exemplary of the invention, which can be embodied in various forms; specific structural and functional details disclosed are not to be interpreted as limiting, but merely as a basis for the claims and as a representative basis for teaching one skilled in the art to variously employ the present invention in virtually any appropriately detailed structure. The title, headings, terms and phrases used are not intended to limit the subject matter or scope; but rather, to provide an understandable description of the invention. The invention is composed of several sub-parts that serve a portion of the total functionality of the invention independently and contribute to system level functionality when combined with other parts of the invention. The terms "a" or "an" are defined as: one or more than one. The term "plurality" is defined as: two or more than two. The term "another" is defined as: at least a second or more. The terms "including" and/or "having" are defined as comprising (i.e., open language). The term "coupled" is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of' in the claims herein is not intended to invoke the provisions of 35 U.S.C. Sec. 112, Paragraph 6.

Incorporation by Reference: All publications, patents, patent applications and Internet website addresses mentioned in this specification are incorporated by reference to the same extent as if each individual publication, patent, or patent application was specifically and individually indicated to be incorporated by reference;

Related Art, which are also incorporated by reference into this application:

U.S. Pat. Nos. 3,283,182; 4,425,115; 4,526,571; 4,750,488; 4,930,512; 5,167,619; 5,221,282; 5,811,909; 6,086,369; 7,762,979; 9,962,183; US Publ. Appl. 2010/0044460b820; U.S. Pat. No. 6,278,218; EP0933138A2; US Publ. Appl. 20150151058A1; U.S. Pat. Nos. 5,152,456A; 6,539,937B1; U.S. Publ. Appl. 2017/0197041b820; U.S. Publ. Appl. 2017/0120284b820; U.S. Publ. Appl. 2004/0047485b820; U.S. Publ. Appl. 2008/0128527b820; U.S. Pat. Nos. 10,335,754; 10,272,404; 8,610,334.

We claim:

1. A vibrating piezoelectric atomizer for atomizing a liquid comprising:

a piezoelectric tube having a length, a first end and a second end and electrodes, which are connected to a power source;

a resonator;

a first endcap and a second endcap engage the first end and the second end of the piezoelectric tube and the resonator;

a metallic disk is connected to one of the endcaps near the first end of the piezoelectric tube;

whereby by applying an alternating voltage across electrodes of the piezoelectric tube, the piezoelectric tube is excited into a resonant vibration when frequency of excitation equals to half wavelength resonant frequency of the piezoelectric tube's length and vibrates in synchronism and is communicated to the metallic disk to atomize the liquid.

2. The vibrating piezoelectric atomizer of claim 1, wherein the metallic disk is perforated.

3. The vibrating piezoelectric atomizer of claim 1, wherein the metallic disk has at least one hole and a plastic cover with perforations.

4. The vibrating piezoelectric atomizer of claim 1, wherein the second resonator comprises a mass-spring-mass mechanical oscillator with the casing being the spring and the caps being the masses.

5. The vibrating piezoelectric atomizer of claim 1, wherein a wick transfers the liquid to the metallic disk.

6. The vibrating piezoelectric atomizer of claim 1, wherein the piezo body has an inside surface and an outside wall; the electrical contacts are coupled to the inner surface and outside wall.

7. The vibrating piezoelectric atomizer of claim 1, wherein use of right-hand and left-hand threads ensures that the tightening process does not introduce torsion to the piezo tube.

8. The vibrating piezoelectric atomizer of claim 1, wherein the resonator lies approximately at a center portion of the length of the piezoelectric tube and where there is very little vibratory motion.

9. A vibrating piezoelectric atomizer for atomizing a liquid comprising:

a piezoelectric transducer tubular body, having a length, a first end defining an opening, a second end and connected electrodes to a power source;

the second end of the piezoelectric transducer tubular body is connected to a horn;

the horn is dimensioned to be a half wavelength resonator;

the horn is folded and located alongside the piezoelectric transducer tubular body;

a metallic disk is connected to the horn near the first end of the piezoelectric transducer tubular body;

whereby by applying an alternating voltage from a battery across the connected electrodes of the piezoelectric transducer tubular body, the piezoelectric transducer tubular body is excited into a resonant vibration when frequency of excitation equals to half wavelength resonant frequency of the piezoelectric transducer tubular body's length and vibrates in synchronism and is communicated to the metallic disk to atomize the liquid.

10. The vibrating piezoelectric atomizer of claim 9, wherein the metallic disk is perforated.

11. The vibrating piezoelectric atomizer of claim 9, wherein the metallic disk has at least one hole and a plastic cover with perforations.

12. The vibrating piezoelectric atomizer of claim 9, wherein the horn lies within the piezoelectric transducer tubular body.

13. The vibrating piezoelectric atomizer of claim 9, wherein the horn lies outside the piezoelectric transducer tubular body.

14. The vibrating piezoelectric atomizer of claim 9, wherein a wick transfers the liquid to the metallic disk.

15. The vibrating piezoelectric atomizer of claim 9, wherein the piezoelectric transducer tubular body has an inside surface and an outside wall; the electrical contacts are coupled to the inner surface and outside wall.

16. The vibrating piezoelectric atomizer of claim 9, wherein the power source is a battery.

* * * * *